US007368645B2

(12) United States Patent
Armstrong et al.

(10) Patent No.: US 7,368,645 B2
(45) Date of Patent: May 6, 2008

(54) INSTRUMENT SUPPORT

(75) Inventors: Joe Armstrong, Somerville, MA (US); Alice R. Dietrich, Boston, MA (US)

(73) Assignee: The Portabene Company, LLC, Boston, MA (US)

( * ) Notice: Subject to any disclaimer, the term of this patent is extended or adjusted under 35 U.S.C. 154(b) by 0 days.

(21) Appl. No.: 11/372,358

(22) Filed: Mar. 8, 2006

(65) Prior Publication Data

US 2006/0207405 A1 Sep. 21, 2006

Related U.S. Application Data

(60) Provisional application No. 60/659,809, filed on Mar. 8, 2005.

(51) Int. Cl.
*G10D 1/02* (2006.01)

(52) U.S. Cl. ..... 84/278

(58) Field of Classification Search ..... 84/278, 84/279

See application file for complete search history.

(56) References Cited

U.S. PATENT DOCUMENTS

| | | | |
|---|---|---|---|
| 451,744 | A | 5/1891 | Albert |
| 491,372 | A | 2/1893 | Narberti |
| 775,792 | A | 11/1904 | Becker |
| 850,775 | A | 4/1907 | Morrissey |
| 932,844 | A | 8/1909 | Beisheim |
| 1,087,066 | A | 2/1914 | Locke |
| 1,156,925 | A | 10/1915 | Poehland |
| 1,199,685 | A | 9/1916 | Gaylord |
| 1,296,414 | A | 3/1919 | McLay |
| 1,416,644 | A | 5/1922 | Jordan |
| 1,431,007 | A | 10/1922 | Kenne |
| 1,721,919 | A | 7/1929 | Meyers |
| 1,742,305 | A | 1/1930 | Connell |
| 1,756,676 | A | 4/1930 | Colbentson |
| 1,786,478 | A | 12/1930 | Connell |
| 1,841,393 | A | 1/1932 | Arthur |
| 1,879,386 | A | 9/1932 | Medakovic |
| 1,920,850 | A | 8/1933 | Ebert |
| 1,958,451 | A | 5/1934 | Syverston |
| 1,971,552 | A | 8/1934 | Fisher |
| 2,004,356 | A | 6/1935 | Westman |

(Continued)

FOREIGN PATENT DOCUMENTS

DE 29707438 U1 * 6/1997 ..... 84/278

OTHER PUBLICATIONS

Wolf, "Work, rests and play", The Strad, Nov. 2001 (2 pages).

(Continued)

*Primary Examiner*—Kimberly Lockett
(74) *Attorney, Agent, or Firm*—Grossman Tucker Perreault & Pfleger, PLLC

(57) ABSTRACT

An instrument support may be used to support an instrument, such as a violin or a viola, against collar-bone/shoulder and chest regions of a player. The instrument support may include a collar-bone rest and a chest rest, providing a dual plane design. The rests may be adjustable to adjust the location on the back of the instrument and to adjust the heights and angles with respect to the instrument to suit the anatomical differences between players.

13 Claims, 10 Drawing Sheets

U.S. PATENT DOCUMENTS

| | | | | |
|---|---|---|---|---|
| 2,064,925 | A | | 12/1936 | Kolitsch |
| 2,110,023 | A | | 3/1938 | McGowan |
| 2,208,824 | A | | 7/1940 | Weinberg |
| 2,216,052 | A | | 9/1940 | Spetseris |
| 2,248,854 | A | | 7/1941 | Coffeen et al. |
| 2,478,530 | A | | 8/1949 | Hall |
| 2,483,052 | A | | 9/1949 | Humphrey |
| 2,489,101 | A | | 11/1949 | Mills |
| 2,489,321 | A | | 11/1949 | Nyhagen |
| 2,522,944 | A | | 9/1950 | Goldberger |
| 2,524,526 | A | | 10/1950 | Hines |
| 2,575,569 | A | | 11/1951 | Ungh |
| 2,591,164 | A | | 4/1952 | Klein |
| 2,652,739 | A | | 9/1953 | Hall |
| 2,697,374 | A | | 12/1954 | Ungh |
| 2,746,336 | A | | 5/1956 | Bisharat |
| 2,747,452 | A | | 5/1956 | Goldberger |
| 3,138,050 | A | | 6/1964 | Tevis |
| 3,407,695 | A | | 10/1968 | Perlman |
| 3,631,754 | A | | 1/1972 | Kun |
| 3,690,211 | A | | 9/1972 | Long |
| 3,727,509 | A | * | 4/1973 | Henkle ..... 84/278 |
| 3,728,928 | A | | 4/1973 | Looser, nee Menge et al. |
| 3,896,694 | A | | 7/1975 | Goldner |
| D247,642 | S | | 3/1978 | Watson |
| 4,212,222 | A | | 7/1980 | Henkle |
| 4,248,125 | A | | 2/1981 | Everett |
| 4,333,378 | A | | 6/1982 | Hrdlicka |
| 4,386,548 | A | | 6/1983 | Wolf |
| 4,389,916 | A | | 6/1983 | Ruthstrom |
| 4,506,582 | A | | 3/1985 | Goldner |
| 4,884,487 | A | | 12/1989 | Feldkamp |
| 4,913,027 | A | | 4/1990 | Twohy |
| 4,951,541 | A | | 8/1990 | McMillan |
| D334,019 | S | | 3/1993 | Kun |
| 5,208,409 | A | | 5/1993 | Roulet |
| D338,222 | S | * | 8/1993 | Steinberger ..... D17/20 |
| 5,270,474 | A | | 12/1993 | Kun |
| 5,275,078 | A | | 1/1994 | Wolf |
| D352,053 | S | | 11/1994 | Murray |
| 5,377,573 | A | | 1/1995 | Tretick |
| 5,419,226 | A | | 5/1995 | Kun |
| 5,507,213 | A | | 4/1996 | Beseke |
| 5,567,893 | A | | 10/1996 | Kun |
| D385,292 | S | | 10/1997 | Kun |
| 5,731,531 | A | | 3/1998 | Kun |
| 5,780,756 | A | | 7/1998 | Babb |
| D406,269 | S | | 3/1999 | Mach |
| 5,883,315 | A | | 3/1999 | Kaplan et al. |
| 6,031,163 | A | | 2/2000 | Cullum et al. |
| 6,143,964 | A | | 11/2000 | Chen |
| 6,239,337 | B1 | | 5/2001 | Stein |
| 6,278,044 | B1 | | 8/2001 | Ruan |
| 6,369,303 | B1 | | 4/2002 | Hvezda |
| 6,670,533 | B1 | | 12/2003 | Yeh |
| 6,756,531 | B2 | | 6/2004 | Ruan |
| 6,891,093 | B2 | | 5/2005 | Huang |
| 2003/0167896 | A1 | | 9/2003 | Vanden et al. |

OTHER PUBLICATIONS

Kun—The Shoulder Rest: Musicians' Health Section: Tools, "Tools for Preventing and Healing Pain", http://www.kunrest.com/tools.htm, May 27, 2003 (5 pages).

Ruan, "Comford Violin Shoulder Cradle—A New Invention for Violinists and Violists" Flyer from Comfort, LLC (1 page).

Shar—sharmusic.com Summer Sale Catalog, pp. 7-9 (4 pages).

Shar—sharmusic.com Jan. 2006 Catalog, pp. 69-71 (4 pages).

Shar- sharmusic.com Holiday Gift Guide 2004, p. 29 (2 pages).

Johnson String Instrument 2004-2005 Mail Order Catalog, pp. 37-39 (4 pages).

PCT International Search Report dated May 3, 2007, received in corresponding PCT Application No. PCT/US06/08752, 3 pgs.

PCT Written Opinion dated May 3, 2007, received in corresponding PCT Application No. PCT/US06/08752, 3 pgs.

Ruan, "Comford Violin Shoulder Cradle—A New Invention for Violinists and Violists" Flyer from Comfort, LLC (1 page), no date.

Shar—sharmusic.com Summer Sale Catalog, pp. 7-9 (4 pages), no date.

* cited by examiner

INSTRUMENT SUPPORT

CROSS-REFERENCE TO RELATED APPLICATIONS

This application claims the benefit of co-pending U.S. Provisional Patent Application Ser. No. 60/659,809, filed on Mar. 8, 2005, which is fully incorporated herein by reference.

TECHNICAL FIELD

The present invention relates to supports for instruments and more particularly, to an instrument support for supporting a violin or viola against a collar-bone, chest and/or shoulder of a player.

BACKGROUND INFORMATION

To play an instrument such as the violin or viola, the player supports and/or secures the instrument against the body generally in the upper chest and shoulder region. Most violinists and violists use two accessories for helping them support their instrument securely between their chin/jaw and their shoulder area—a "chin rest" and a "shoulder rest." The need for such devices arose in the 19$^{th}$ century when composers like Paganini, Beethoven, and Brahms began writing music for the violin of such increased range and virtuosity that it required players to clamp their instrument more firmly between their chin/jaw and their shoulder area. Before that time (i.e., in the days of Bach and Mozart), players could usually get by with merely resting their instrument on their collar bone or upper chest near the shoulder because most of the music was more contained in range.

The chin rest was devised first for the top of the instrument, and the idea of a shoulder rest for the bottom of the instrument came later. Various shoulder rest designs have been used including soft, spongy padding and single bar designs with feet clamps. While players may be able to find a suitable chin rest among the many models available, shoulder rest designs have generally failed to meet the need for a secure and anatomically suitable support below the instrument. Existing shoulder rest designs also cannot be fully adjusted to accommodate differences among players, for example, in neck length and shoulder/collar-bone/chest shape.

Existing shoulder rests also cannot be fully adjusted to accommodate different approaches to holding the instrument in the vertical plane relative to the ground and in the horizontal plane relative to both the central axis of the player's body and to their sternal notch. When players attempt to position some existing shoulder supports optimally on the instrument, they simply snap off during an intense performance, which can be disruptive to a concert and damaging to the instrument. Other existing supports hamper the sound of the instrument by resting in contact with some portion of its back, or by exerting a clamping force from directly opposing points on the sides of its back.

The ineffective designs of the current supports also force players to create extra tension in the shoulder area and elsewhere. This may cause shoulder/arm/hand tightness and musicians' injuries such as tendonitis, carpal tunnel syndrome, focal dystonia, thoracic outlet syndrome, tenosynovitis, tendinosis, DeQuervain's syndrome, myofascial pain syndrome, cubital tunnel syndrome and trigger finger/thumb. Such injuries have led to the use of re-educational and rehabilitative methods such as the Alexander Technique, which helps to establish a balanced use of the neck, head and torso musculature. Although the Alexander Technique provides relief from built up tightness and re-educates muscular co-ordination for supporting and playing an instrument, it only highlights the inadequacy of the existing shoulder rests, which require extra tension to be made.

Accordingly, there is a need for an instrument support capable of providing secure and anatomically suitable support below the instrument. There is also a need for an instrument support capable of being adjusted to suit differences between players.

BRIEF DESCRIPTION OF THE DRAWINGS

These and other features and advantages will be better understood by reading the following detailed description, taken together with the drawings wherein.

DETAILED DESCRIPTION

Figure 1:
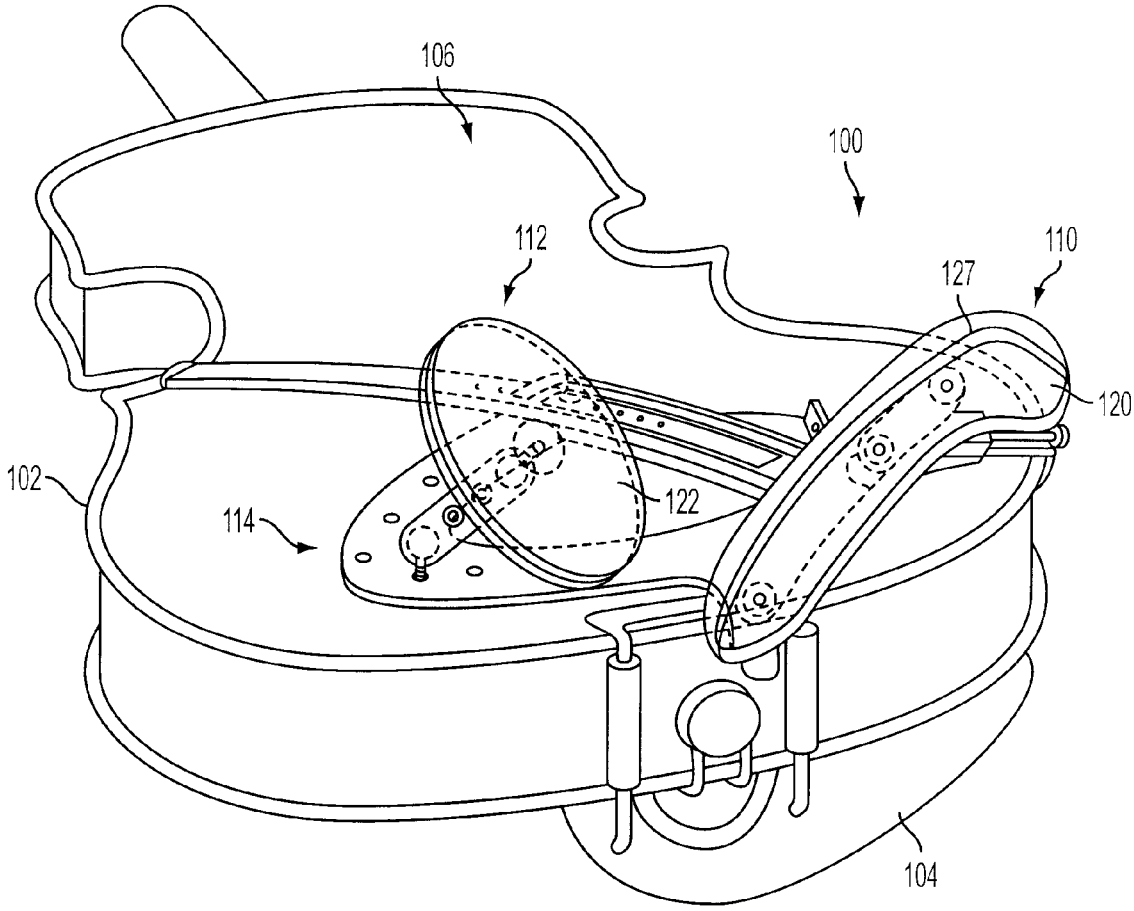
FIG. 1 is a perspective view of an instrument support mounted on an instrument, consistent with one embodiment of the present invention.

Referring to FIG. 1, an instrument support 100, consistent with one embodiment of the present invention, is shown for use with an instrument 102. The instrument support 100 supports the instrument 102 on the player's collar-bone/shoulder and chest regions, as will be described in greater detail below. The instrument support 100 may be used together with a chin rest 104 of the various types known to those skilled in the art. In the exemplary embodiments, the instrument support 100 is used with a violin or viola. Those skilled in the art will recognize that the instrument support may also be used with other types of instruments that are positioned between the player's chin and collar-bone/shoulder and chest regions.

Figure 13:
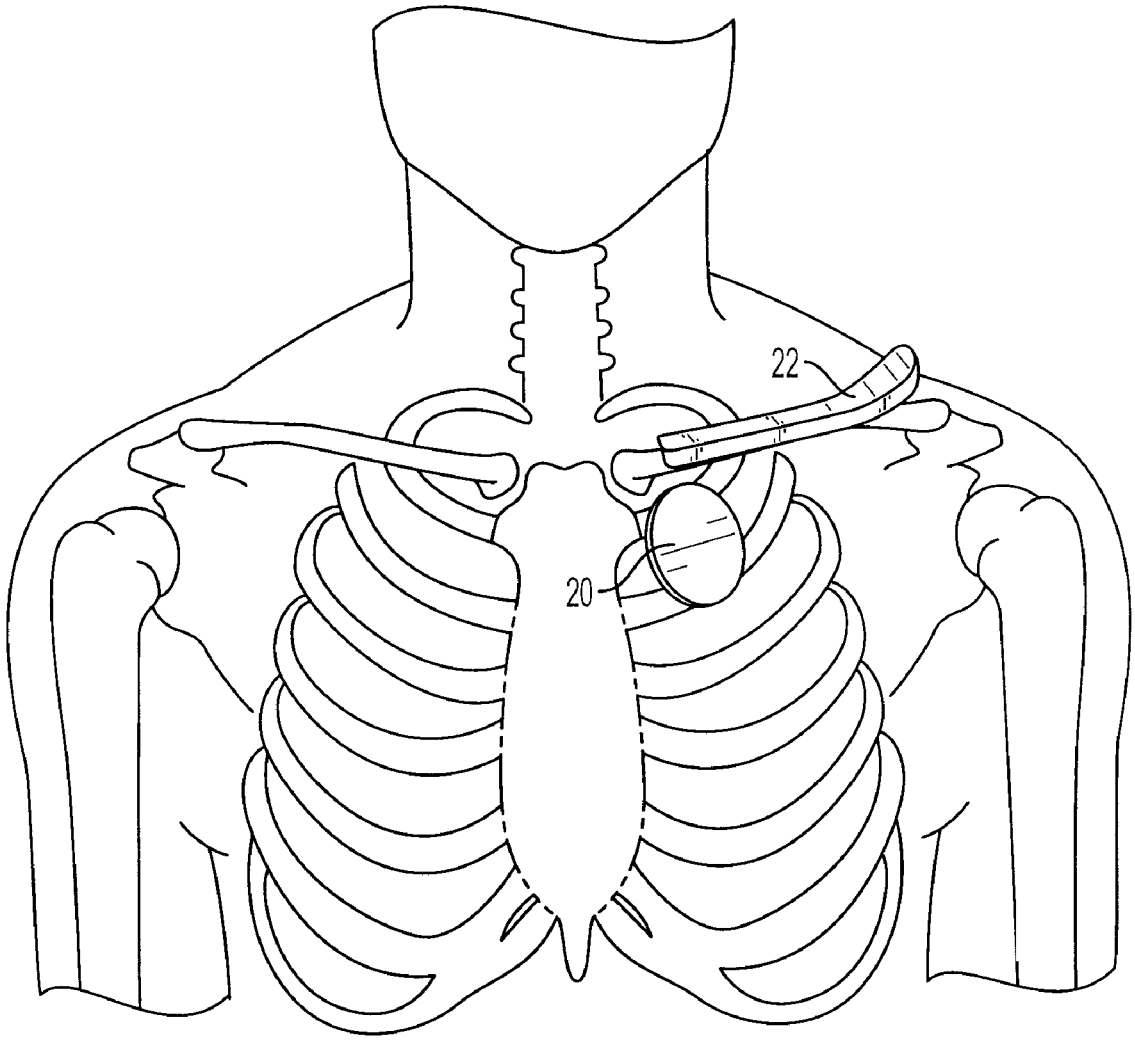
FIG. 13 is a schematic diagram of a human skeletal structure illustrating the regions on the user's body that are contacted by the rests of the instrument support, consistent with one embodiment of the present invention.

One embodiment of the instrument support 100 may include a collar-bone rest 110, a chest rest 112, and a mounting system 114. The mounting system 114 mounts the collar-bone rest 110 and the chest rest 112 to the back side 106 of the instrument 102. The collar-bone rest 110 includes a first outer surface 120 configured to contact the collar-bone region of the player. The first outer surface 120 of the collar-bone rest 110 may also extend to the shoulder region of the player. The chest rest 112 includes a second outer surface 122 configured to contact the chest region of the player. The exemplary embodiment of the instrument support 100 thus has a dual plane design in that first and second surfaces 120, 122 of the collar-bone rest 110 and the chest rest 112, respectively, generally tilt and extend in first and second planes that align with the collar-bone/shoulder region 20 and the chest region 22 of the player, as shown in FIG. 13. Although the collar-bone rest 110 and the chest rest 112 are shown as separate elements, the rests 110, 112 may be an integral or one-piece construction.

Providing primary contact on the collar-bone advantageously allows proper support of the instrument by allowing for a perpendicular clamping force to be established between the player's chin/jaw contact on the chin rest 104 and the player's collar-bone directly below the chin. The exemplary collar-bone rest 110 distributes the forces along the collar-bone toward its juncture with the acromion process near the shoulder joint and extending on over the top of the shoulder (see FIG. 13). Providing a dual plane design with two contact planes advantageously supplements the perpendicular clamping force between the player's chin/jaw and collar-bone/shoulder area by allowing for a secondary, angular clamping force between the player's chin/jaw and the player's chest area. The combined distribution of clamping forces between the two planes allows the player's shoulder joint and upper arm to remain free from being required to support the instrument, thereby enabling the entire arm, hand, fingers, and thumb to operate in an optimal manner while playing the instrument.

Figure 3:
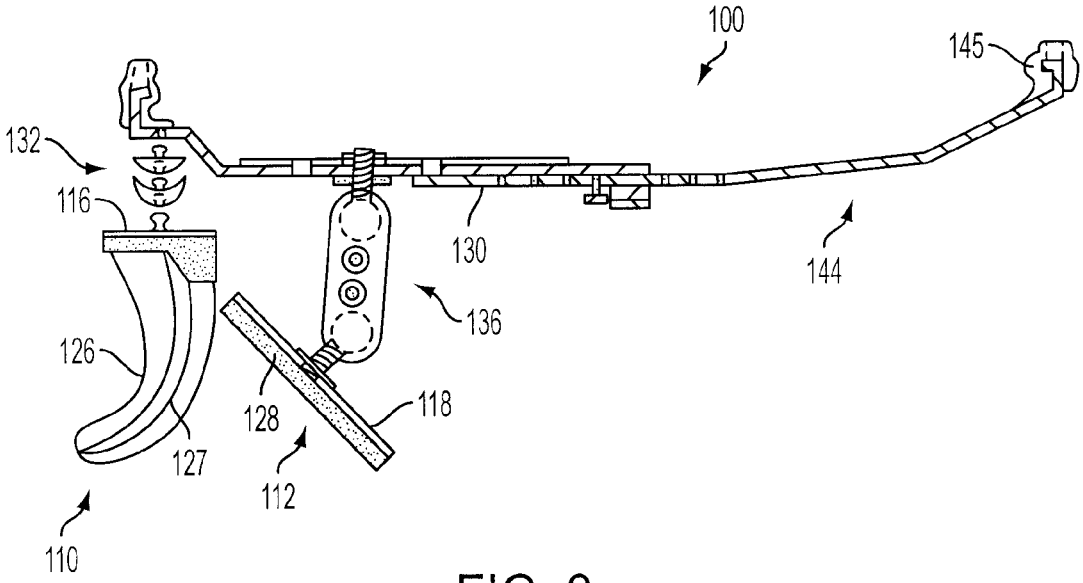
FIG. 3 is a partially cross-sectional side view of the instrument support shown in FIG. 1.
Figure 4:
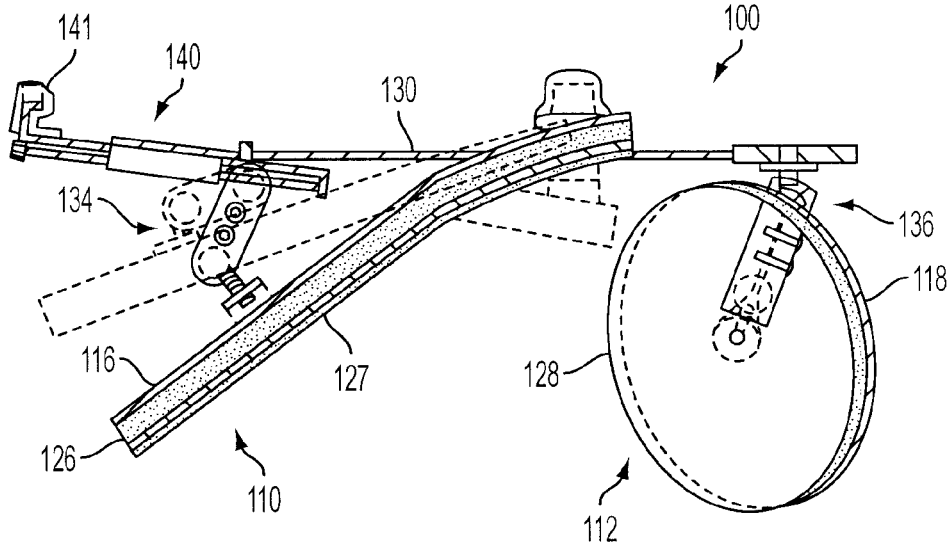
FIG. 4 is a partially cross-sectional end view of the instrument support shown in FIG. 1 showing the collar-bone rest movable between different positions.
Figure 5:
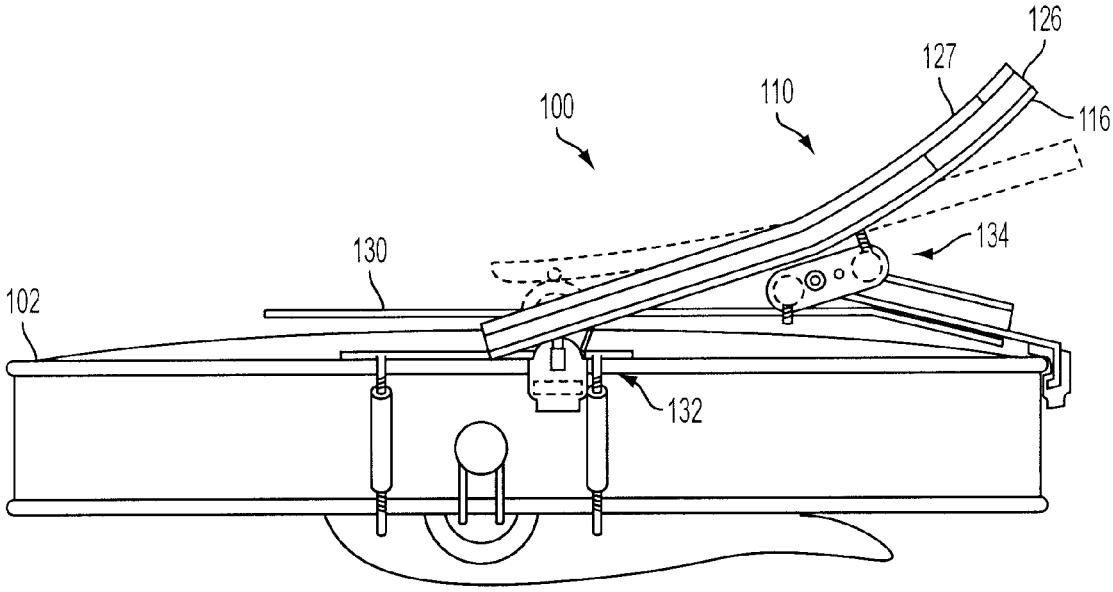
FIG. 5 is an end view of one embodiment of the instrument support mounted on the instrument and showing the collar-bone rest movable between different positions.

One embodiment of the collar-bone rest 110 is shown in greater detail in FIGS. 3, 4 and 5. The collar-bone rest 110 may have a length sufficient to extend and curve along at least a portion of the player's collar-bone and over at least a portion of the top of the player's shoulder. The collar-bone rest 110 may have a width sufficient to span the top and front plane of the collar-bone in such a way that it distributes the clamping force securely, equally, and comfortably along both the top and front of the collar-bone and over the top of the shoulder. According to one embodiment, the length of the collar-bone rest 110 is in the range of about 4¾ in. to about 6 in., and the width of the collar-bone rest 110 is in the range of about ¾ in. on the breastbone end to about 1 in. on the shoulder end. The collar-bone rest 110 may have an oblong shape with rounded ends and may be curved on the shoulder end to conform to the shape of the top of the shoulder. The collar-bone rest 110 may be pliable by hand to conform in a refined way to each individual player's collar-bone and shoulder shape.

Figure 6:
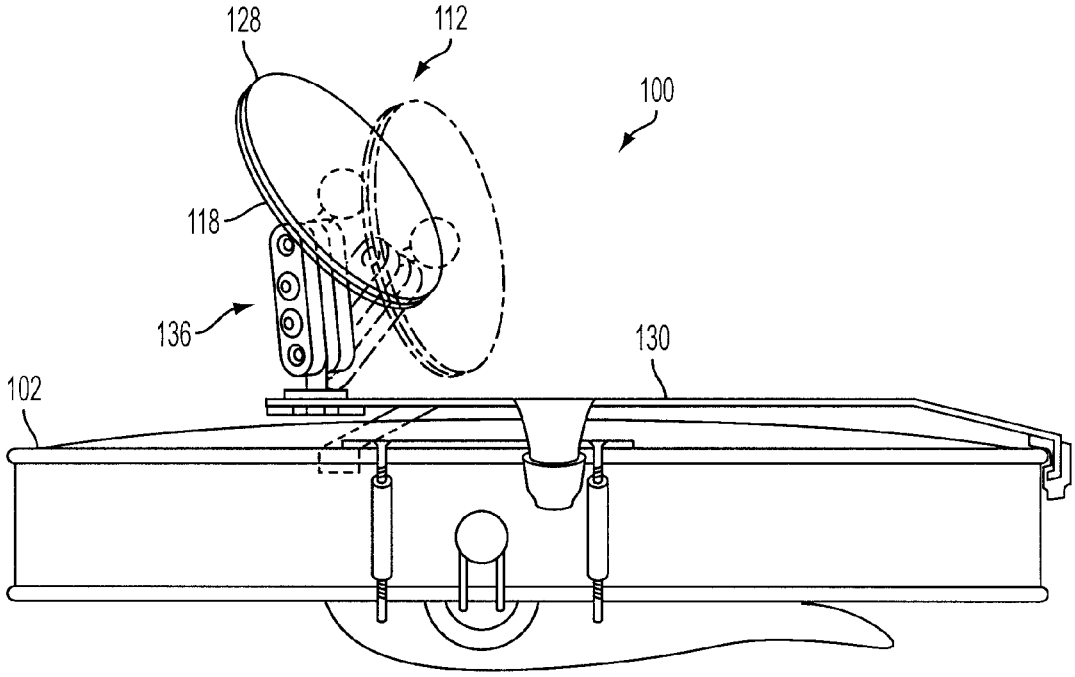
FIG. 6 is an end view of one embodiment of the instrument support mounted on the instrument and showing the chest rest movable between different positions.

One embodiment of the chest rest 112 is shown in greater detail in FIGS. 3, 4 and 6. The chest rest 112 may have a length and width sufficient to extend along a more vertical plane on the upper chest of the player. In one embodiment, the length of the chest rest 112 is in the range of about 3 in. to about 3½ in., and the width of the chest rest 112 is in the range of about 2 in. to about 2½ in. The chest rest 112 may have a generally oval shape. Although the illustrated embodiment shows a particular shape of the rests 110, 112, other shapes and sizes are within the scope of the present invention.

The rests 110, 112 may include rest supports 116, 118 covered with a layer of cushioning material 126, 128. The rest supports 110, 112 may be made, for example, of a pliable material such as a hand-pliable aluminum. The layer of cushioning material 126, 128 may be made, for example, of rubber. One embodiment of the collar-bone rest 110 may also include an additional thin strip of padding 127 made of, for example, rubber (FIGS. 1, 3 and 5) along the edge of the collar-bone rest 110 farthest from the neck of the player to provide a second supplementary supportive contact in the vertical plane along the front of the collar-bone/shoulder. The supplementary supportive contact may combine with the vertical support of the chest rest 112 in further preventing the instrument 102 from falling in the vertical plane toward the ground.

As shown in greater detail in FIGS. 2-6, the mounting system 114 may include a base 130 and one or more attachment members 132-136 that attach and support the collar-bone rest 110 and the chest rest 112 to the base 130. The base 130 may be designed to accommodate both supports 110, 112 without significantly affecting the sound of the instrument 100. In one embodiment, the base 130 defines a space 131 to allow sound from the back of the instrument 102 to travel through the base 130. The base 130 may be made of a lightweight and strong metal or plastic. The base 130 may include attachment points **138*a*-138*i* configured to attach to the attachment members 132-136. The attachment points 138*a*-138*i* may include threaded or unthreaded holes or apertures that engage the attachment members 132-136, as described in greater detail below. The base 130 may also include tabs (not shown) extending from the base to attach to the attachment members 132-136. The attachment members 132-136 may also be formed integrally with either the base 130 or with the rests 110, 112**.

The attachment members 132-136 may be adjustable to allow the height and angle of the rests 110, 112 to be adjusted relative to the instrument 100. In one embodiment, the shoulder end of the collar-bone rest 110 may be adjusted (e.g., using the attachment member 134) in a range of about ½ in. to about 1½ in. The breastbone end of the collar-bone rest 110 may also be adjustable (e.g., using the attachment member 132) in a range of about 0 in. to about 1½ in. The angle between the collar-bone rest 110 and the back side 106 of the instrument 102 may be adjusted in the range of about 45 degrees. In one embodiment, the chest rest 112 may be adjusted (e.g., using the attachment member 136) in a range of about ½ in. to about 2½ in. The angle between the chest rest 112 and the back side 106 of the instrument 102 may be adjusted (e.g., using the attachment member 136) in the range of about 45 degrees.

Figure 7A:
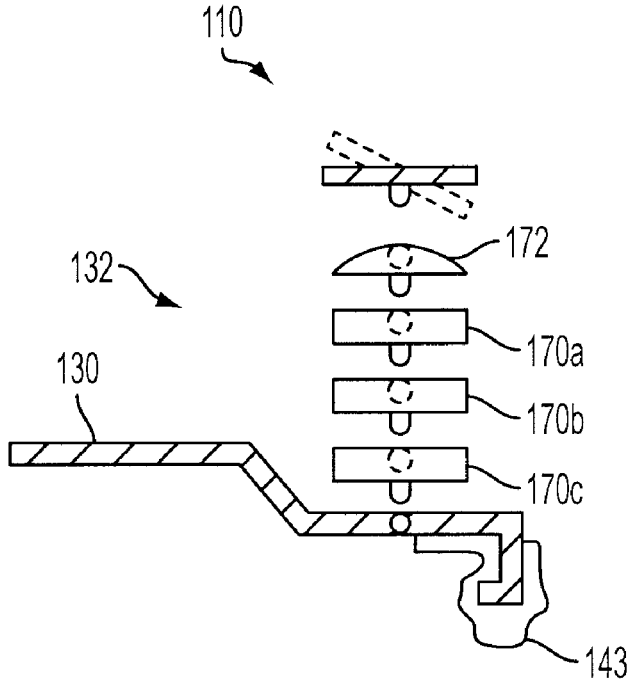
FIGS. 7A and 7B are side and end views of an interlocking strut for attaching and supporting one end of the collar-bone rest, consistent with one embodiment of the present invention.
Figure 7B:
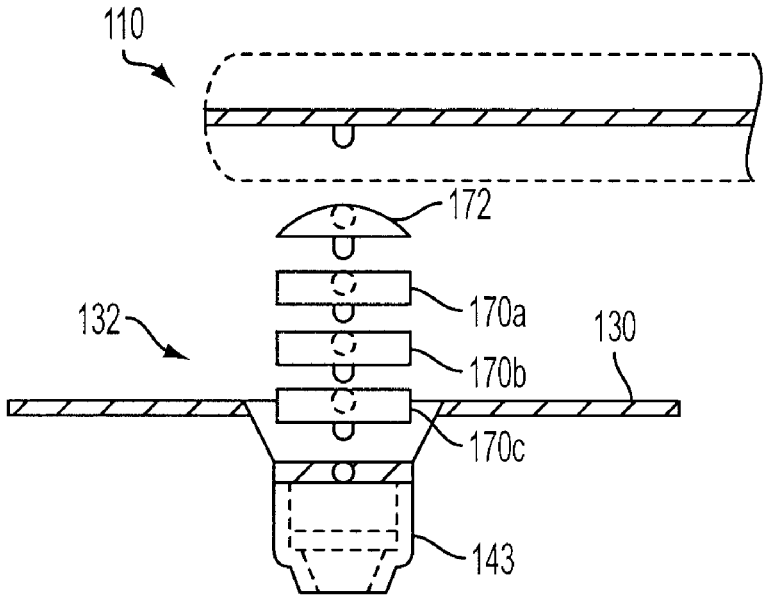

According to one embodiment, as shown in FIGS. 7A and 7B, at least one of the attachment members 132 may be a strut in the form of interlocking cartridges or shim discs 170*a*-170*c*, 172 that allow for a raising and lowering of the breastbone end of the collar-bone rest 110 relative to the mounting system and the back of the instrument. A bottom shim disc 170*c* may engage the base 130 and a top shim disc 172 may engage the collar-bone rest 110. The top shim disc 172 may have a rounded top surface to allow pivoting of the collar-bone rest 110. The interlocking shim discs 170*a*-170*c*, 172 may include ball and socket connections that allow the shim discs 170*a*-170*c* to swivel relative to each other, allowing the collar-bone rest 110 to be angled. The interlocking shim discs 170*a*-170*c* may be removable to raise and/or lower the collar-bone rest 110.

Figure 8A:
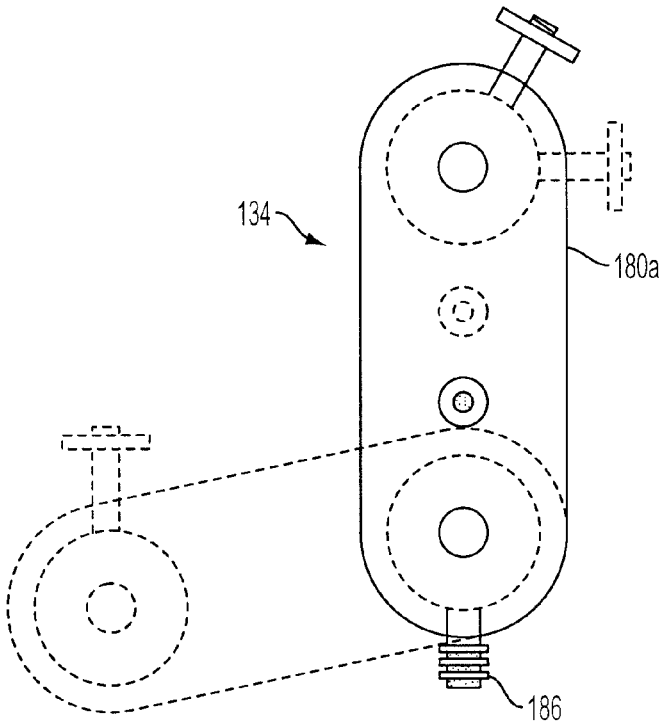
FIGS. 8A and 8B are front and side views of a double ball strut for attaching and supporting another end of the collar-bone rest, consistent with one embodiment of the present invention.
Figure 8B:
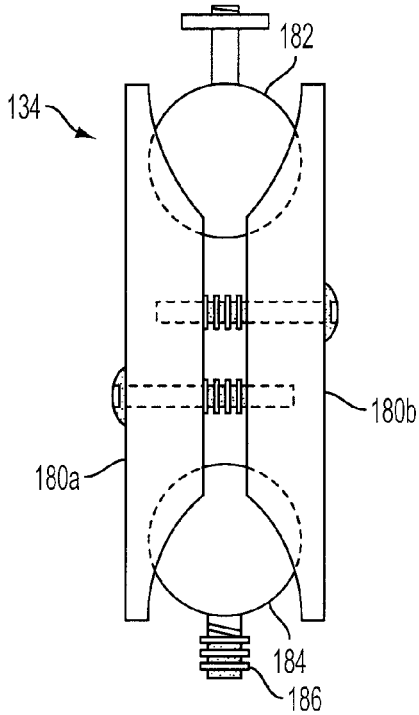

According to one embodiment, shown in FIGS. 8A-8B, the attachment member 134 may be a double-ball strut (e.g., of metal or plastic) that allows for raising, lowering, and angling of the shoulder end of the collar-bone rest 110 relative to the mounting system 114 and back of the instrument 102. Strut members 180*a*, 180*b* may be clamped against first and second balls 182, 184. The first ball 182 may be attached to the collar-bone rest 110 and the second ball 184 may be attached to the base 130. In this embodiment, the second ball 184 may include a threaded shaft 186 that threadably engages an aperture in the base 130 to secure the second ball 184.

Figure 9A:
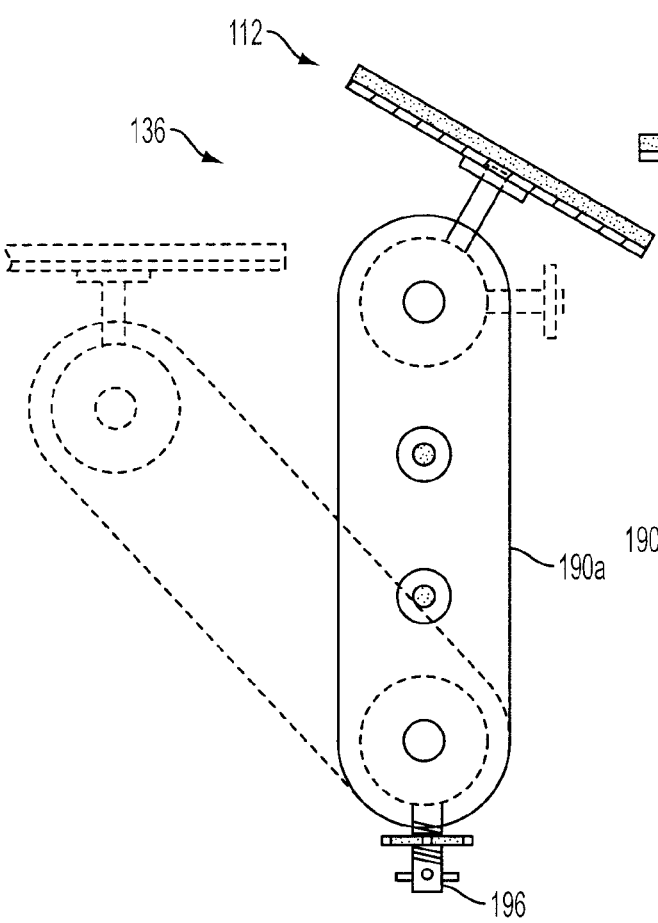
FIGS. 9A and 9B are front and side views of a double ball strut for attaching and supporting the chest rest, consistent with one embodiment of the present invention.
Figure 9B:
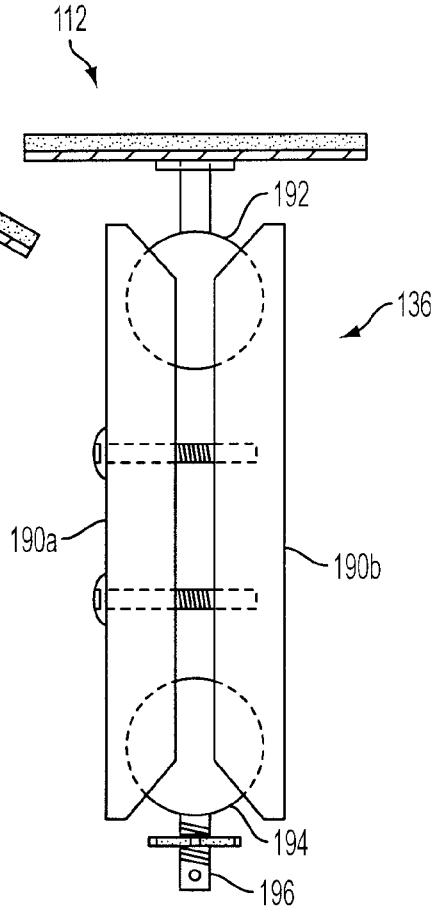
Figure 10A:
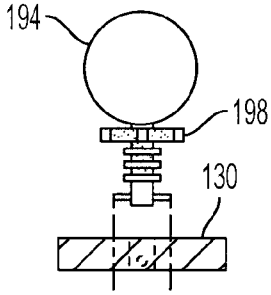
FIGS. 10A-10D are side views of a lower ball of a double ball strut in different positions of engagement with a base of the instrument support, consistent with one embodiment of the present invention.
Figure 10B:
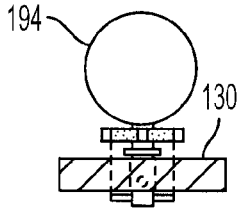
Figure 10C:
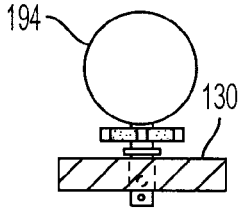
Figure 10D:
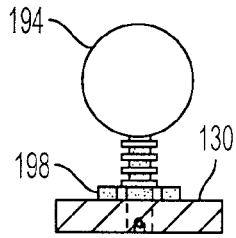

According to one embodiment, shown in FIGS. 9A-9B, the attachment member 136 may be a double-ball strut (e.g., of metal or plastic) that allows for raising, lowering, turning, and/or angling of the chest rest 112 relative to the mounting system 114 and back of the instrument 102. Strut members 190*a*, 190*b* may be clamped against first and second balls 192, 194. The first ball 192 may be attached to the chest rest 112 and the second ball 194 may be attached to the base 130. In this embodiment, the second ball 194 includes an engagement portion 196 that may be rotated into locking engagement with the base 130, as shown in detail in FIGS. 10A-10D. The engagement portion 196 may be inserted through an aperture in the base 130 (FIG. 10B) and rotated (e.g., about 90°) (FIG. 10C). The second ball 194 may then be retracted such that a pin on the engagement portion 196 engages a groove in the base 130. A nut 198 may then be threaded along the engagement portion 196 into contact with the base 130 to secure the second ball 194.

Although the rests 110, 112 are shown attached to the base 130 using attachment members 132-136, the rests 110, 112 may be attached directly to the base 130. Those skilled in the art will recognize that other adjustable attachment members, such as turnbuckles, or non-adjustable attachment members may also be used.

Figure 2:
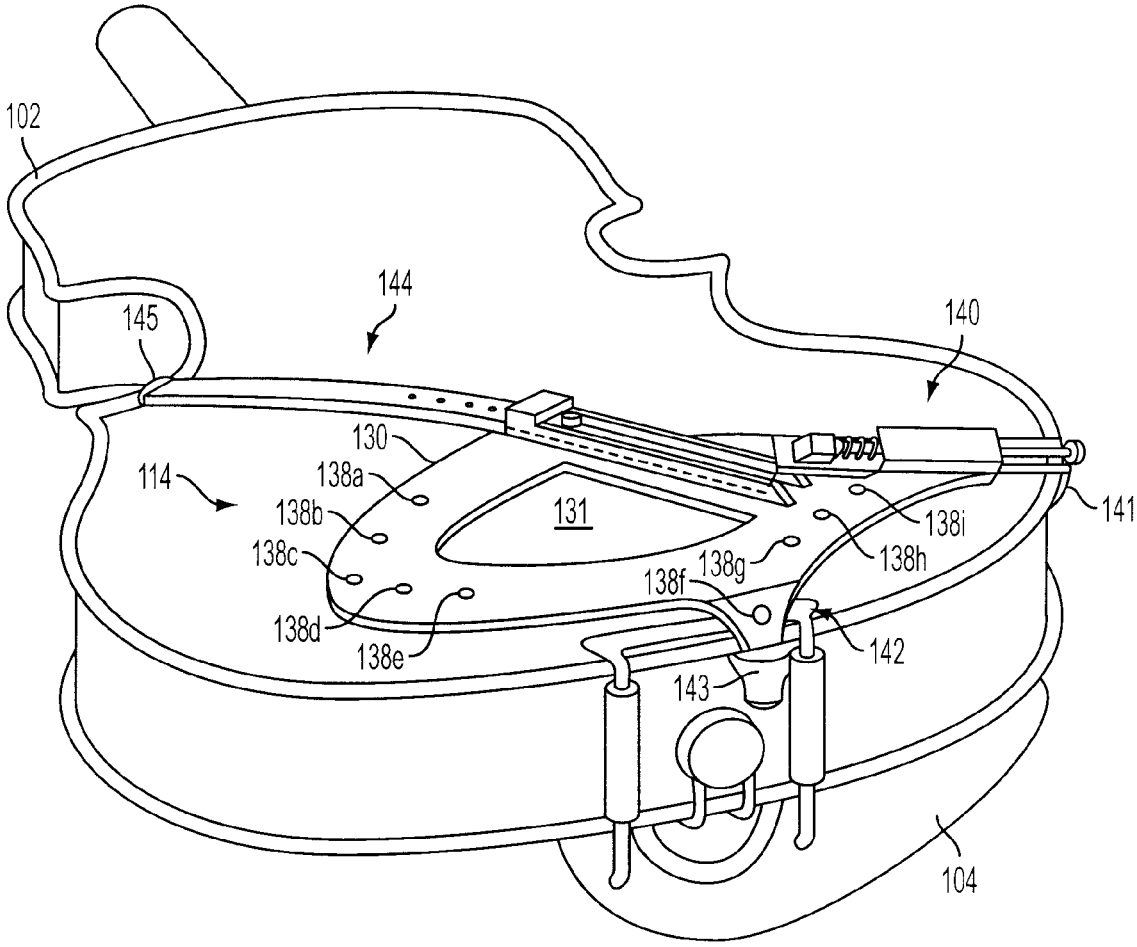
FIG. 2 is a perspective view of an instrument support mounting system consistent with one embodiment of the present invention.

As shown in FIG. 2, the mounting system 114 may also include mounting members 140, 142, 144 extending from the base 130 and configured to engage the outside edges of the instrument 102 (see FIG. 2). The mounting members 140, 142, 144 may include padded hooks 141, 143, 145 that engage the edge of the instrument 102. In one embodiment, three mounting members 140, 142, 144 engage the instrument 102 in three different locations. This allows the base 130 to be securely positioned in the desired location with respect to the differing locations of the attachments of the mounting systems of the various types of chin rests. The three point mounting allows the base 130 to be securely positioned with respect to each player's preferred angle of holding the instrument relative to the ground and relative to the central axis of their body and relative to their sternal notch at the top of their breastbone. The first mounting member 140 may engage the instrument 102 at the lower side region of the instrument 102. The second mounting member 142 may engage the instrument 102 at the bottom region of the instrument 102. The third mounting member 144 may engage the instrument 102 at the waist region of the instrument. This 3-point or triangulated engagement of the instrument 102 using the mounting members 140, 142, 144 distributes the clamping force of the mounting system 114 broadly over the back of the instrument 106.

Figure 11A:
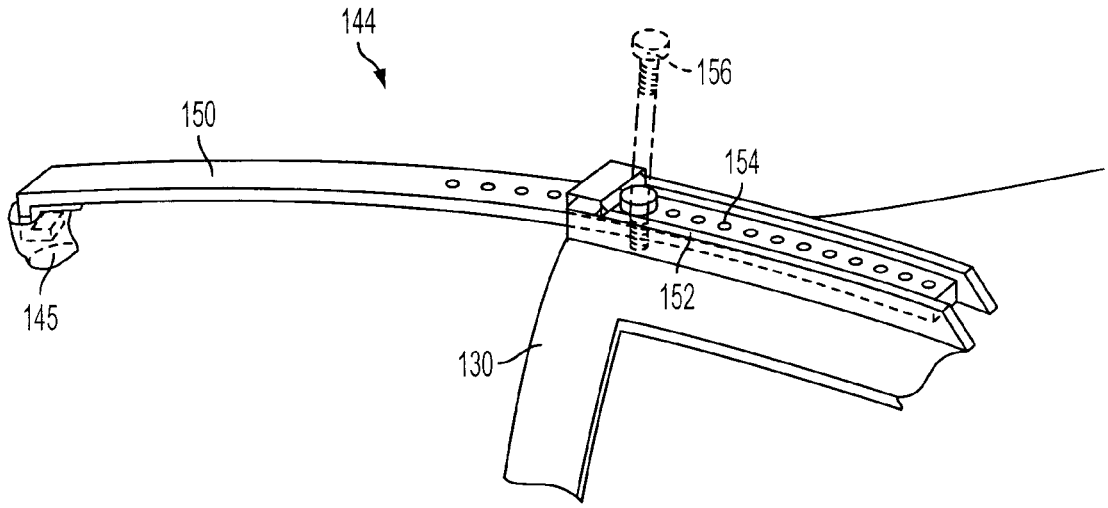
FIGS. 11A and 11B are end and side views of a mounting member used to mount the instrument support to a waist of the instrument, consistent with one embodiment of the present invention.
Figure 11B:
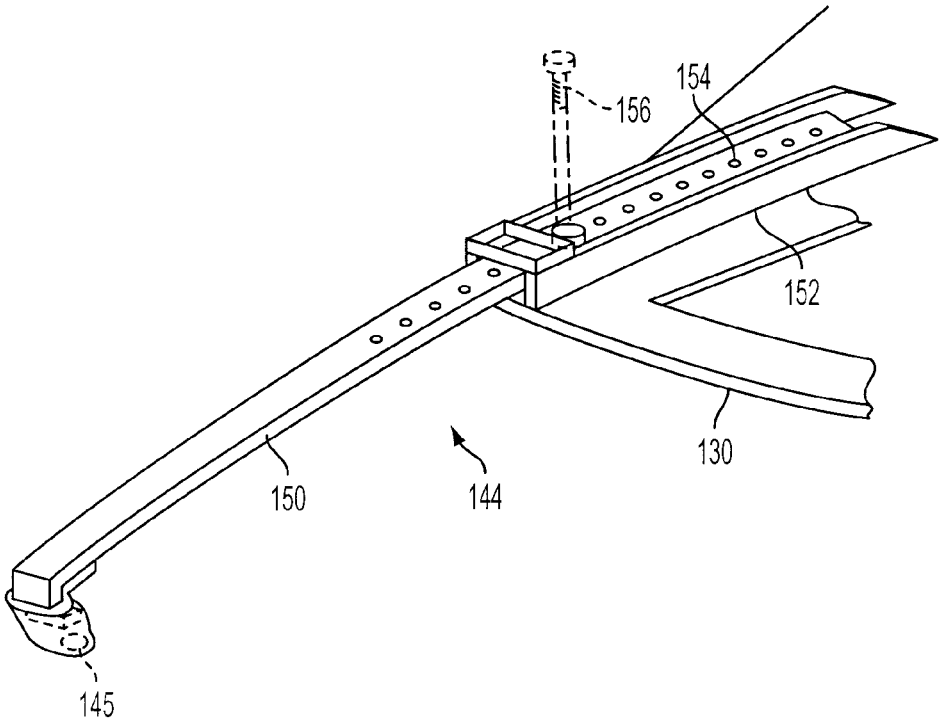

One or more of the mounting members 140, 142, 144 may be adjustable to allow the mounting members 140, 142, 144 to be adjusted to fit instruments of various sizes and shapes. Referring to FIGS. 11A-11B, for example, the mounting member 144 may include a strip 150 that slidably engages a slot 152 on the base 130. The strip 150 may be adjustably connected to the base 130 with a fastener 156 that threadably engages a threaded portion 154. The strip 150 may thus be used to adjust the mounting member 144 against the waist of the instrument.

Figure 12A:
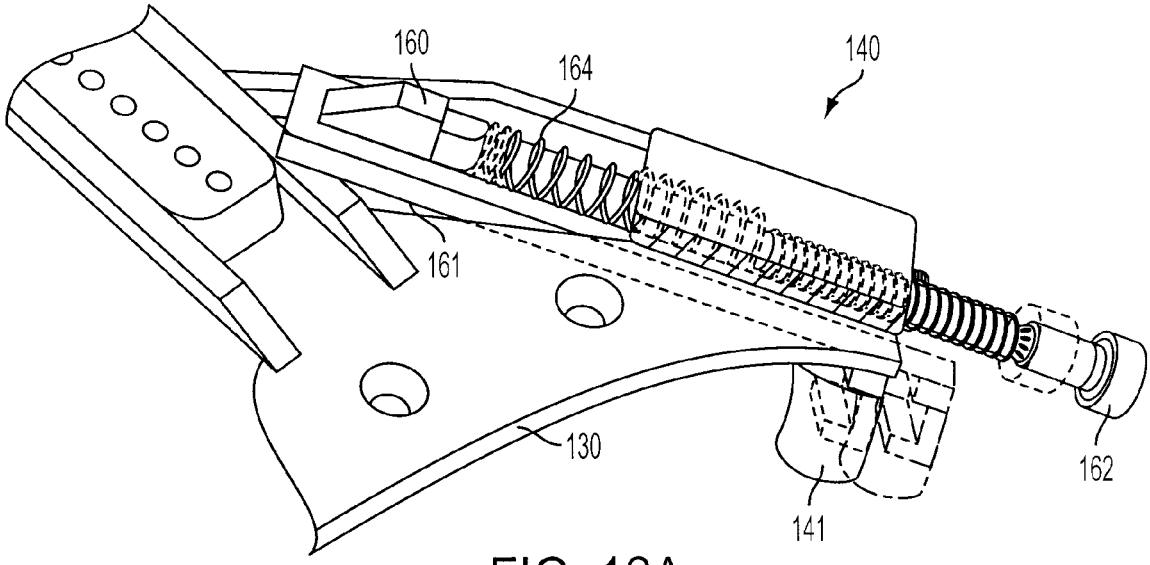
FIG. 12A is an end view of a mounting member used to mount the instrument support to a lower side of the instrument, consistent with one embodiment of the present invention.
Figure 12B:
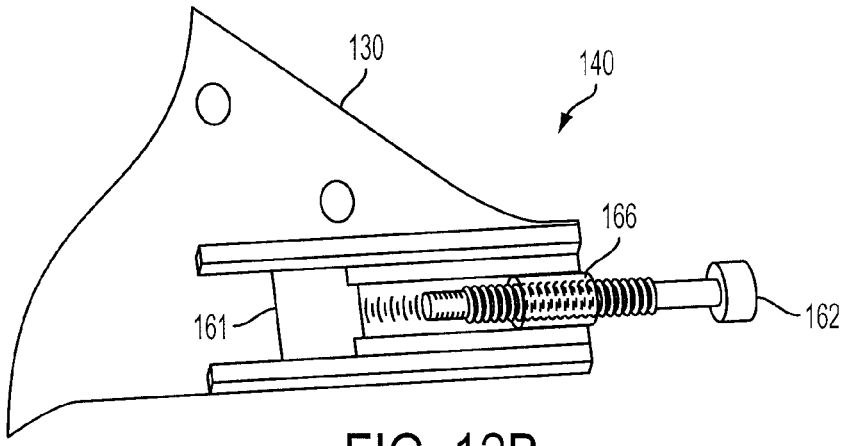
FIG. 12B is a bottom view of the adjusting mechanism used in the mounting member shown in FIG. 12A.
Figure 12C:
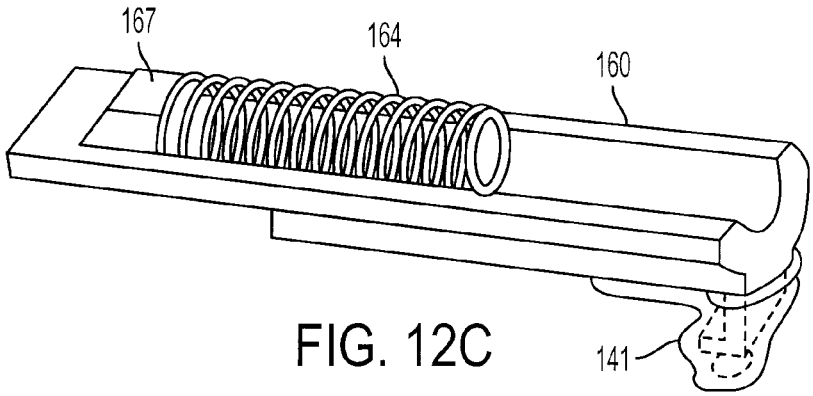
FIG. 12C is a top view of an insert leg and spring used in the lower slide mounting member shown in FIG. 12A.

Referring to FIGS. 12A-12C, the mounting member 140 may include an insert leg 160 that slidably engages a slot 161 in the base 130. A threaded fastener 162 extends between the mounting member insert leg 160 and a threaded portion 166 to engage a spring 164 between the threaded fastener 162 and a block 167 near the interior end of the mounting member 140. The threaded fastener 162 may thus be used to adjust the mounting member 144 against the lower side of the instrument.

Alternatively, one or more of the mounting members 140, 142, 144 may be resilient such that the mounting members may stretch or flex to engage the instrument 102, while still maintaining a degree of arc above the back of the instrument. Although the illustrated embodiment shows mounting members 140, 142, 144 as flat strips, bars or plates, those skilled in the art will recognize that other structures and configurations may be used. Those skilled in the art will also appreciate that there are other ways to adjust the mounting members 140, 142, 144.

The mounting system 114 may be mounted to the instrument 102 such that the collar-bone rest 110 and the chest rest 112 may each be independently and optimally positioned for the player. The collar-bone rest 110, for example, should be positioned in a location proximate the end of the instrument 102 and generally opposite the chin rest 104 on the front side 108 of the instrument 102. The mounting system 114 advantageously allows the collar-bone rest 110 to be properly positioned near the end of the instrument 102 without danger of snapping off during a performance which also provides the contact for a balanced perpendicular clamping force between the player's chin/jaw and the collar-bone/shoulder. An adjustable mounting system 114 advantageously allows the collar-bone rest 110 and the chest rest 112 to be adjusted and positioned independently according to the anatomical differences of each player and with respect to each player's preferred angle of holding the instrument relative to the ground and relative to the central axis of their body and to their sternal notch. Although the illustrated embodiment shows one type of mounting system, those skilled in the art will recognize that other types of mounting systems may be used to mount the collar-bone rest 110 and the chest rest 112.

Consistent with one embodiment of the present invention, an instrument support includes a collar-bone rest configured to be mounted to a back side of an instrument. The collar-bone rest includes a first outer surface configured to contact at least a collar-bone region of a player of the instrument. The instrument support also includes a chest rest configured to be mounted to the back side of the instrument adjacent to the collar-bone rest. The chest rest includes a second outer surface configured to contact at least a chest region of the player.

Consistent with another embodiment of the present invention, an instrument support includes a mounting system configured to be mounted to a back side of an instrument. A collar-bone rest is coupled to the mounting system and includes a first outer surface extending generally in a first plane and configured to contact a collarbone region of a player. A chest rest is coupled to the mounting system and includes a second outer surface extending generally in a second plane different from the first plane and configured to contact a chest region of the player.

Consistent with a further embodiment of the present invention, a method of supporting a musical instrument includes: positioning a collar-bone rest against a collar-bone region of a player of the musical instrument; positioning a chest rest against a chest region of the player of the musical instrument, wherein the collar-bone rest and the chest rest are located on one side of the musical instrument and generally oriented in different planes; and positioning a chin of the player in a chin rest located on an opposite side of the musical instrument, such that the chin rest is opposite the collar-bone rest.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. An instrument support comprising:

a collar-bone rest configured to be mounted to a back side of an instrument, said collar-bone rest including a first outer surface configured to contact at least a collar-bone region of a player of the instrument;

a chest rest configured to be mounted to said back side of the instrument adjacent to said collar-bone rest, said chest rest including a second outer surface configured to contact at least a chest region of the player; and a mounting system configured to mount said collar-bone rest and said chest rest to said back side of said instrument such that said mounting system distributes a force applied to said collar-bone rest and said chest rest over said back side of said instrument, wherein said mounting system includes adjustable attachment members configured to adjust said collar-bone rest and said chest rest relative to said instrument, wherein said adjustable attachment members include at least one collar-bone rest attachment member, wherein said at least one collar-bone rest attachment member is configured to adjust a distance of said collar-bone rest relative to said mounting system, and wherein said at least one collar-bone rest attachment member is configured to adjust an angular orientation of said collar-bone rest relative to said mounting system.

2. The instrument support of claim 1 wherein said adjustable attachment members include at least one chest rest attachment member, wherein said chest rest attachment member is configured to adjust a distance of said chest rest relative to said mounting system, and wherein said chest rest attachment member is configured to adjust an angular orientation of said chest rest relative to said mounting system.

3. The instrument support of claim 1 wherein said adjustable attachment members include at least first and second collar-bone rest attachment members.

4. The instrument support of claim 1 wherein said mounting system includes at least three mounting members configured to secure said instrument in at least three locations.

5. The instrument support of claim 1 wherein said collar-bone rest is configured to contact a top and front of the collar-bone region of the player.

6. The instrument support of claim 1 wherein said collar-bone rest is configured to extend from the collarbone of the player to a shoulder region of the player.

7. The instrument support of claim 1 wherein said collar-bone rest includes a rest support member and a cushioning material supported on at least a portion of said rest support.

8. The instrument support of claim 1 wherein said chest rest includes a rest support member and a cushioning material supported on at least a portion of said rest support.

9. An instrument support comprising:

a mounting system configured to be mounted to a back side of an instrument, wherein said mounting system includes at least three mounting members configured to secure said instrument in at least three locations;

a collar-bone rest coupled to said mounting system, said collar-bone rest including a first outer surface extending generally in a first plane and configured to contact a collarbone region of a player;

a chest rest coupled to said mounting system, said chest rest including a second outer surface extending generally in a second plane different from said first plane and configured to contact a chest region of the player; and wherein said collar-bone rest and said chest rest are coupled to said mounting system in locations such that the mounting system distributes a force applied to said collar-bone rest and said chest rest over said back side of said instrument.

10. The instrument support of claim 9 wherein said mounting system is configured to mount said collar-bone rest proximate an end of said instrument in a region opposite a chin rest mounted on a front side of said instrument.

11. The instrument support of claim 9 wherein said mounting system includes adjustable attachment members coupled to said collar-bone rest and said chest rest, wherein said adjustable attachment members are configured to adjust said collar-bone rest and said chest rest relative to said instrument.

12. A method of supporting a musical instrument, comprising:

mounting said collar-bone rest and said chest rest to a back side of said musical instrument using a mounting system that secures the musical instrument in at least three locations around an edge of the instrument, and wherein said collar-bone rest and said chest rest are mounted such that said mounting system distributes a force applied to said collar-bone rest and to said chest rest over said back side of said musical instrument;

positioning a collar-bone rest against a collar-bone region of a player of the musical instrument opposite a chin of the player; and positioning a chest rest against a chest region of the player of the musical instrument, wherein said collar-bone rest and said chest rest are located on one side of the musical instrument and are generally oriented in different planes.

13. The method of claim 12 further comprising adjusting an orientation of at least one of said collar-bone rest and said chest rest relative to the musical instrument.

* * * * *